United States Patent [19]

Toyoda et al.

[11] 3,989,635

[45] Nov. 2, 1976

[54] PROCESS FOR IMPROVING GRANULAR DETERGENTS

[75] Inventors: Sadao Toyoda; Kuniyoshi Takenouchi, both of Funabashi; Norihiro Ohno, Chofu; Noboru Hara, Tokyo, all of Japan

[73] Assignee: Lion Fat & Oil Co., Ltd., Tokyo, Japan

[22] Filed: Sept. 6, 1974

[21] Appl. No.: 503,669

[30] Foreign Application Priority Data

Sept. 10, 1973 Japan ..... 48-102404

[52] U.S. Cl. ..... 252/135; 252/174; 252/385; 427/212; 427/214

[51] Int. Cl.[2] ..... C11D 3/08; C11D 11/00

[58] Field of Search ..... 252/135, 156, 383, 385, 252/537, 539, 174; 427/212–214

[56] References Cited

UNITED STATES PATENTS

| | | | |
|---|---|---|---|
| 2,480,579 | 8/1949 | Holuba | 252/531 |
| 2,768,095 | 10/1956 | Tadema et al. | 117/100 |
| 2,846,401 | 8/1958 | McCarthy et al. | 252/385 X |
| 3,154,497 | 10/1964 | Mankowich | 252/135 |
| 3,231,506 | 1/1966 | Schulerud | 252/540 |

*Primary Examiner*—Thomas J. Herbert, Jr.
*Assistant Examiner*—Bruce H. Hess
*Attorney, Agent, or Firm*—Woodhams, Blanchard and Flynn

[57] ABSTRACT

A process for improving the properties of granular detergents, that is, caking preventability, fluidity and particle hardness, which comprises spray-coating a coating agent [I] consisting of the silicates, sulfates, carbonates and hydroxides of alkali metals and a coating agent [II] consisting of polyvalent metal sulfates separately onto a granular detergent obtained by the conventional spray granulating method, tumbling granulating method, piston granulating method, pressure granulating method and the like, under a condition in which the granular detergent is in a fluid state; causing a reaction on the surface of the granular detergent particles; and forming thereon a coating film of a water-insoluble or poorly water-soluble substance.

12 Claims, No Drawings

PROCESS FOR IMPROVING GRANULAR DETERGENTS

BACKGROUND OF THE INVENTION a. Field of the Invention

The present invention relates to a process for improving the properties of granular detergents, which comprises treating the surface of the granular detergent obtained by the conventional methods for preparing granular detergents, for instance, spray granulating method, tumbling granulating method, piston granulating method, pressure granulating method and so forth thereby to make possible the maintenance of excellent caking preventability, fluidity and particle hardness extending over a long period of time.

b. Description of the Prior Art

The majority of the available heavy duty detergents are manufactured by the spray granulating method, tumbling granulating method, pressure granulating method and so forth. These kinds of detergents are convenient for use, but on the other hand are liable to become caked by contact with moisture in the air.

Therefore, the aforesaid detergent particles adhere to each other in high moisture conditions, and thereby are likely to undergo a blocking or caking phenomenon. Such a phenomenon has made said detergents extremely hard to handle and also has reduced their commercial value.

Granular detergents as aforesaid, which are inferior in fluidity, cause troubles when they are taken out of a storage silo or are charged into a carton, and even after charging thereof in the carton they undergo caking phenomena therein thereby to deteriorate their value as articles of commerce. Such being the case, there has been a demand for the improvement of the fluidity and caking preventability of detergent particles.

In addition, the problem of preventing the growth of algae in bodies of water recently has publicly been taken account of, and therefore there is a tendency to limit the use of phosphates in detergents, but the fluidity and caking preventability of such detergents is inclined to be worse. Accordingly, the need for improvement of properties of granular detergents has become more important.

In this regard, U.S. Pat. No. 2,648,609 and U.S. Pat. No. 3,117,027 have each disclosed a method of forming a film, which is to act as a protective coating, onto the surfaces of detergent particles by means of coating while putting the detergent particles in a fluid state.

In fact these patents are concerned with methods and apparatus aiming at uniform coating, but there still remains a great number of unsolved problems, such as, the coating is liable to be irregular; much aggregation takes place between particles; particles adhere to wall surfaces; the methods are not suitable for mass production; and the like. Therefore, those methods and apparatus are not fully satisfactory.

The term "caking preventability" herein means the ability of the detergent particles not to adhere to each other under high temperature and high humidity conditions and not to become caked, and the term "fluidity" means that the angle of repose of detergent particles, in other words the dischargability of detergent particles out of the storage silo.

SUMMARY OF THE INVENTION

The object of the present invention is to provide a relatively simple process for conspicuously improving the caking preventability and, in addition, for imparting fluidity to granular detergents obtained by conventional methods for manufacturing granular detergents.

In other words, the present invention relates to a process for improving the properties of granular detergents, which comprises spraying a coating agent [I] selected from the group consisting of an aqueous solution of the silicates, carbonates and hydroxides of alkali metals alone or in combination with a powder of the silicates, sulfates, carbonates and hydroxides of alkali metals, for instance one kind or more of sodium silicate, sodium carbonate, sodium sulfate, caustic soda, etc. and a coating agent [II] selected from the group consisting of polyvalent metal sulfates, for instance one kind or more of aluminum sulfate, magnesium sulfate, zinc sulfate, etc. respectively onto the granular detergent obtained by the conventional methods for manufacturing granular detergents under the condition wherein the granular detergent is in a fluid state; causing a reaction on the surface of the granular detergent particles; and forming thereon the coating film of water-insoluble and poorly water-soluble substances, for instance alumino silicate, magnesium carbonate, aluminum oxides, magnesium silicate, magnesium hydroxide, etc.

According to the present invention, even when a large quantity of granular detergent is stored or a granular detergent is stored for a long period of time there can not be found any caking caused by the self of the detergent, and there can be obtained granular detergents that are extremely superior in fluidity in comparison with untreated granular detergents. In addition, the present invention is recognized to be more effective in treating granular detergents containing low or no phosphate which are extremely subject to caking.

Referring to the present invention in further detail, the objects to be treated by the process of the present invention are granular detergents obtained by the conventional methods, for instance a spray granulating method, a tumbling granulating method, a piston granulating method, a pressure granulating method, etc. As the detergent material for use in the present process there are enumerated an anionic surface active agent such as sodium linear alkylbenzene sulfonate, sodium $\alpha$-olefin sulfonate, sodium higher alcohol sulfate, sodium of higher fatty acid, etc.; a nonionic surface active agent such as nonyl phenol ethylene oxide adduct, higher alcohol ethylene oxide adduct, etc.; a builder such as sodium tripolyphosphate, sodium sulfate, sodium silicate, soda ash, EDTA, sodium citrate, CMC, etc.; and an additive such as an optical bleaching agent, coloring agent, etc.; but the detergent material is not limited thereto. The granular detergent for use in the present invention can preferably contain 5 to 40% by weight of surface active agents, 40 to 95% by weight of builders and optionally other detergent additives. As for the ingredients constituting the detergent material, as described above it is more desirable that the phosphate content be reduced.

The granular detergent materials obtained by means of these methods are introduced to a revolving drum, a revolving cross drum and a fluidized tower, and particles thereof are put into moderate motion by revolution or air flow.

The particles in motion are spray-coated with an aqueous solution of at least one coating agent [I] selected from the group consisting of the aforesaid silicates, carbonates and hyroxides of alkali metals and an aqueous solution of at least one coating agent [II] selected from the group consisting of polyvalent metal sulfates, and simultaneously, if needed, a part of the coating agent [I] including also alkali metal sulfates is introduced into the coating machine in the form of a fine powder in order to form a good fluidized state, thereby effecting coating in a predetermined quantity.

The order of spraying these liquid coating agents may be either simultaneous or separately. This is sufficient to achieve the object of the spraying, because the spraying only aims at causing these two kinds of liquid coating agents to react on the surfaces of the granular particles. Further, referring to the effect of introducing a part of the coating agent [I] in fine powder state into the coating machine, it serves to form a water-insoluble and poorly water-soluble coating film on the surfaces of the detergent granules and in addition allows the granular detergent particles to maintain a good motion condition, thereby preventing said particles from agglomelating at the time of coating and completing coating in a shorter time and with higher efficiency than usual. The present invention thus makes it possible to provide a compact equipment capable of mass coating.

As for the quantity of the coating agents added, in the case of the coating agent [I] which consists of silicates, sulfates, carbonates and hydroxides of alkali metal, the aforesaid quantity, calculated as the solids, is in the range of from 0.5 to 8 parts by weight, preferably 0.5 to 5 parts by weight, per 100 parts by weight of the granular detergent, and wherein the adding ratio of the aqueous solution (solid content) to fine powder of said coating agent [I] is in the range of from 1/10 to 10/1, preferably 1/10 to 5/1.

As for the particle size of the powdery coating agent [I], it is desirable that particles of less than 100 mesh comprise more than 80% of the whole. In case the quantity of coating agent [I] added is less than 0.5 part by weight, it has little efficiency in formation of the coating film, and in case more than 8 parts by weight is used the formed coating film is too thick, thereby lowering the solubility of the product granular detergents. And in case of adding a part of the coating agent [I] in powdery state the ratio of the aqueous solution (solid content) to fine powder is preferably in the range of from 1/10 to 10/1, whereby product granular detergents are obtainable which are superior in caking preventability and fluidity.

In the case of the coating agent [II] consisting of polyvalent metal sulfates, there is added, calculated is the solids, in the range of from 1 to 10 parts by weight, preferably in the range of from 2 to 7 parts by weight, as an aqueous solution. The reasons for limiting the addition quantity is identical with that as mentioned in the case of aforesaid coating agent [I].

Referring to the conditions for adding the coating agents [I] and [II], the coating time, though variable depending on the movability of the detergent particles, is in the range of from 10 seconds to 10 minutes, within which the separately sprayed coating agents [I] and [II] rapidly react with each other on the surfaces of the particles, whereby a coating film is formed thereon. The coating time is not desirable to be more than 10 minutes and less than 10 seconds, because in the former there is observed the formation of coarse particles and in the latter the formation of irregular coated particles.

The coating temperature is preferably in the range of from 10° to 250° C. When the temperature is over 250° C, the coating agents [I] and [II] dry into solid matter before adhering onto the surface of detergent particles and they do not react each other. The object of thus limiting the coating temperature is fully achieved by effecting the coating and drying operation at the same time, too.

As for the method of adding the coating agents [I] and [II], any method will do as long as their uniform coating can be effected thereby; for instance, the spraying method using a pressure nozzle, a turbulent nozzle, a two-fluid nozzle, etc. is above all suitable for the present invention.

The thus manufactured product granular detergents are capable of fully achieving the object of the present invention by virtue of the coating film of water-insoluble and poor water-soluble substances obtained as the result of a reaction between the coating agent [I] and the coating agent [II].

Next, the procedures for obtaining improved product granular detergents according to the process of the present invention will be concretely explained, but it is to be noted that the present invention should not be limited thereto.

DESCRIPTION OF THE PREFERRED EMBODIMENTS

EXAMPLE 1

| | |
|---|---|
| Sodium linear dodecyl benzene sulfonate | 20 parts by weight |
| Sodium tripolyphosphate | 20 parts by weight |
| Sodium silicate | 10 parts by weight |
| Sodium carbonate | 5 parts by weight |
| Optical bleaching agent | 1 part by weight |
| CMC | 1 part by weight |
| Sodium sulfate | 33 parts by weight |
| Water | 10 parts by weight |

100 parts by weight of the starting material granular detergent obtained by spray drying a mixture of the above-mentioned ingredients was introduced into a revolving drum. Next, 0.6 part by weight of sodium silicate in an aqueous solution state (Concentration 33 wt %, Temperature 50° C) was spray-added through a nozzle provided within the drum so that it may adhere uniformly onto the surfaces of the detergent particles, and further 1.5 parts by weight of aluminum sulfate in an aqueous solution state (Concentration 27 wt %, Temperature 55° C) was likewise spray-added.

After completion of the reaction of sodium silicate with aluminum sulfate on the surface of the detergent particles there was further added 5 parts by weight of sodium sulfate (Particle size less than 200 mesh) for coating purposes. The coating time was 5 minutes. The thus coated detergent particles were introduced from the revolving drum to a fluidized bed dryer, and are dried at 200° C for 20 seconds to thereby obtain the product granular detergent. The properties of this detergent were as shown in Table-1.

COMPARATIVE EXAMPLE 1

According to Example 1 the properties of the material granular detergent per se were as shown in Table-1.

COMPARATIVE EXAMPLE 2

A product granular detergent was prepared in accordance with the same procedures and conditions as those in Example 1 except that an aqueous solution of sodium silicate was added. The properties of the thus prepared granular detergent were as shown in Table-1.

COMPARATIVE EXAMPLE 3

A product granular detergent was obtained in accordance with the same procedures and conditions as those in Example 1 excepting for the addition of an aqueous solution of aluminum sulfate. The properties of the thus obtained granular detergent were as shown in Table-1.

COMPARATIVE EXAMPLE 4

A product granular detergent was obtained in accordance with the same procedures and conditions as those in Example 1 except that an aqueous solution of sodium silicate was mixed with an aqueous solution of auminum sulfate prior to addition thereof and said mixture was spray-added. The properties of the thus obtained granular detergent were as shown in Table-1.

EXAMPLE 2

2 parts by weight of sodium silicate in an aqueous solution state (Concentration 33 wt %, Temperature 50° C) was added to 100 parts by weight of the starting material granular detergent of Example 1 in accordance with the same procedures as in Example 1, and thereafter 6 parts by weight of aluminum sulfate in an aqueous solution state (Concentration 20 wt %, Temperature 30° C) was added to the same. The coating time was 10 minutes. This coated granular detergent was dried at 200° C for 25 seconds to obtain a product granular detergent. The properties of the thus obtained detergent were as shown in Table-1.

EXAMPLE 3

| | |
|---|---|
| Sodium linear alkyl benzene sulfonate | 20 parts by weight |
| Sodium α-olefin sulfonate | 5 parts by weight |
| Sodium silicate | 15 parts by weight |
| Optical bleaching agent | 1 part by weight |
| CMC | 1 part by weight |
| Sodium sulfate | 48 parts by weight |
| Water | 10 parts by weight |

To 100 parts by weight of a material granular detergent obtained by spray-drying a mixture of above-mentioned ingredients was added 3 parts by weight of aluminum sulfate in an aqueous solution state (Concentration 10 wt %, Temperature 22° C) in accordance with the same procedures as in Example 1, and thereafter 1 part by weight of sodium silicate in an aqueous solution state (Concentration 15 wt %, Temperature 25° C) was added thereto. Then, after completion of the reaction of aluminum sulfate with sodium silicate on the surface of the detergent particles there was further added 6 parts by weight of soda ash (particle size 100 mesh or less) and coating was effected. The coating time was 15 minutes. The thus coated detergent particles were dried at 150° C for 30 seconds to obtain a product granular detergent. The properties of the thus obtained detergent were as shown in Table-1.

EXAMPLE 4

To 100 parts by weight of the starting material granular detergent of Example 3 was added 7 parts by weight of aluminum sulfate in an aqueous solution state (Concentration 25 wt %, Temperature 55° C), and thereafter 2 parts by weight of sodium silicate in an aqueous solution state (Concentration 20 wt %, Temperature 25° C) was further added thereto. The coating time was 5 minutes. The thus coated detergent particles were dried at 200° C for 30 seconds to obtain a product granular detergent. The properties of this detergent were as shown in Table-1.

EXAMPLE 5

A liquid composition consisting of sodium linear alkyl benzene sulfonate, sodium silicate and powdery composition consisting of sodium tripolyphosphate, sodium carbonate, sodium sulfate, CMC and optical bleaching agent, were granulated by a pin granulator into detergent particles having a particle diameter of 0.5 to 2.0 mm.

The intermediate granular detergent containing in the following proportion was obtained by drying above-mentioned detergent particles at 250° C for 20 seconds.

| | |
|---|---|
| (1) Liquid composition | |
| Sodium linear alkyl benzene sulfonate | 15 parts by weight (D.M) |
| Sodium silicate | 10 parts by weight (D.M) |
| (2) Powdery composition | |
| Sodium tripolyphosphate | 30 parts by weight |
| Fluorescent agent | 1 part by weight |
| CMC | 1 part by weight |
| Sodium sulfate | 38 parts by weight |
| Water | 5 parts by weight |

Thereafter an aqueous solution of sodium silicate (the same one as in Example 1) was added to 100 parts by weight of this material granular detergent in accordance with the same procedures as in Example 1, and thereto was further added an aqueous solution of aluminum sulfate (the same one as in Example 1) to form a coating on the surface of detergent particles. Said particles were subjected to aging for 6 hours to obtain a product granular detergent. The properties of thus obtained detergent were as shown in Table-1.

COMPARATIVE EXAMPLE 5

The properties of the material granular detergent per se according to Example 5 were as shown in Table-1.

Table-1

| | | Fluidity* (angle of repose) | Solidification preventability** (%) | Pressure solidification property*** (%) |
|---|---|---|---|---|
| Detergent under the present invention | Example 1 | 43° | 5 | 0 |
| | Example 2 | 45° | 6 | 0 |
| | Example 3 | 43° | 0 | 0 |
| | Example 4 | 44° | 0 | 0 |
| | Example 5 | 45° | 5 | 0 |
| Comparative Example | Comparative Example 1 | 49° | 100 | 8 |
| | Comparative Example 2 | 51° | 90 | 6 |
| | Comparative | 50° | 80 | 5 |

Table-1-continued

| | Fluidity* (angle of repose) | Solidification preventability** (%) | Pressure solidification property*** (%) |
|---|---|---|---|
| Example 3 | | | |
| Comparative Example 4 | 48° | 80 | 3 |
| Comparative Example 5 | 47° | 70 | 2 |

Remarks:
*The fluidity was measured by an angle at which the sample, being packed in a box of 9.2 × 5.6 × 2.5 cm and having its upper surface being leveled, was gently slanted and began to flow (The less this angle, the better the fluidity).
**The solidification preventability was evaluated through the procedure comprising leaving the sample standing under the atmosphere of 35° C and 100% in relative humidity for 48 hours, then sifting this sample by the use of a 4-mesh sieve, and measuring the amount of sample left on the sieve in terms of wt. %.
***The pressure solidification property was evaluated through the procedure comprising packing the sample in a box of 8 × 10.2 cm, leveling the upper surface thereof, placinga glass plate of 7 × 9 cm, putting a weight of 2 kg thereon, leaving the same standing for 24 hours, then sifting this sample by the use of a 4-mesh sieve, and measuring the amount of sample left on the sieve in terms of wt. %.

EXAMPLE 6

| | |
|---|---|
| Sodium alkyl benzene sulfonate | 20 parts by weight |
| Sodium silicate | 15 parts by weight |
| Sodium carbonate | 5 parts by weight |
| Optical bleaching agent | 1 part by weight |
| CMC | 1 part by weight |
| Sodium sulfate | 53 parts by weight |
| Water | 5 parts by weight |

100 parts by weight of a material granular detergent obtained by spray-drying the composition consisting of above-mentioned ingredients was introduced into a fluidization tower. Then, 3 parts by weight, calculated as the solids, of a 27% aluminum sulfate aqueous solution and 0.5 part by weight, calculated as the solids, of a 10% sesqui sodium carbonate (40° C) were simultaneously spray-added thereto through a two-fluid nozzle provided within a fluidization tower and were made adhere to the surface of detergent particles, and at the same time 2 parts by weight of 100 mesh pass powdery sesqui sodium carbonate was added thereto through the inlet of a gas tube used for fluidizing purposes, said tube being located at the lower part of a coating machine, thereby effecting coating on the surface of detergent particles. The coating time was 1 minute, and the fluid state of particles was very good. The coated detergent particles were introduced into a fluidized bed dryer from the coating machine, and were dried at 200° C for 20 seconds to obtain a product granular detergent. The properties of the thus-obtained detergent were shown in Table-2.

EXAMPLE 7

To 100 parts by weight of the material granular detergent of Example 6 were added 8 parts by weight, calculated as the solids, of a 27% aluminum sulfate aqueous solution according to the same procedure as in Example 6, and simultaneously 2 parts by weight, calculated as the solids, of a 40% caustic soda aqueous solution according to the same procedure as in Example 6 and further 5 parts by weight of sodium carbonate powder having a mean particle diameter of 80 $\mu$. Coating was dried for 3 minutes with air heated to 200° C for use in fluidizing to obtain a product granular detergent. The properties of the thus-obtained detergent were as shown in Table-2.

EXAMPLE 8

To 100 parts by weight of the material granular detergent of Example 6 were added 1 part by weight, calculated as the solids, of a 27% aluminum sulfate aqueous solution according to the same procedure as in Example 6, and simultaneously 0.5 part by weight, calculated as the solids, of a 10% sodium bicarbonate aqueous solution (50° C), and further 0.1 part by weight of sodium bicarbonate having a mean particle diameter of 92 $\mu$. The granulating time was 30 seconds. The coated detergent particles were introduced into a fluidized bed dryer from the coating machine, and dried at 150° C for 20 seconds to obtain a product granular detergent. The properties of the thus-obtained detergent were shown in Table-1.

EXAMPLE 9

A product granular detergent was obtained through the same procedure and conditions as in Example 6 except that 0.5 part by weight, calculated as the solids, of a 15% sodium carbonate aqueous solution was added in the place of sesqui sodium carbonate, and 0.5 part by weight of sodium carbonate powder having a mean particle diameter of 80 $\mu$ was added. The properties of the thus obtained product granular detergent were shown in Table-2.

EXAMPLE 10

| | |
|---|---|
| Linear alkyl benzene sulfonate | 10 parts by weight |
| α-olefin sulfonate | 10 parts by weight |
| Sodium silicate | 15 parts by weight |
| Sodium carbonate | 5 parts by weight |
| Optical bleaching agent | 1 part by weight |
| CMC | 1 part by weight |
| Sodium sulfate | 55 parts by weight |
| Water | 3 parts by weight |

100 parts by weight of a material granular detergent obtained by spray-drying the composition consisting of above-mentioned ingredients was introduced into a fluidization tower. Then, 2.5 parts by weight, calculated as the solids, of a 27% aluminum sulfate aqueous solution and 1 part by weight, calculated as the solids, of a 40% caustic soda aqueous solution were simultaneously spray-added through a two-fluid nozzle, and further 8 parts by weight of sodium bicarbonate having a mean particle diameter of 92 $\mu$ was added thereto. The granulating time was 45 seconds. After completion of the coating operation, the same was introduced into a fluidized bed dryer and dried at 250° C for 15 seconds to obtain a product granular detergent. The properties of the thus obtained detergent were shown in Table-2.

EXAMPLE 11

A product granular detergent was obtained by adding, to 100 parts by weight of the material according to Example 6, 2 parts by weight, calculated as the solids, of a 15% magnesium sulfate aqueous solution (40° C) and simultaneously 0.5 part by weight, calculated as the solids, of a 15% sodium carbonate aqueous solution and further 1 part by weight of sodium carbonate powder having a mean particle diameter of 80 $\mu$ through the same procedure and conditions as in Example 1.

The properties of the thus obtained product granular detergent were shown in Table-1.

EXAMPLE 12

100 parts by weight of the material granular detergent according to Example 5 was introduced into a fluidized bed coating machine and were given a sufficient fluidity. Then, 3.0 parts by weight, calculated as the solids, of a 27% aluminum sulfate aqueous solution and 1.5 parts by weight, calculated as the solids, of a 15% sodium silicate aqueous solution were each simultaneously spray-added, and 7 parts by weight of sodium sulfate powder having a mean particle diameter of 75 $\mu$ was also added thereto. The coating time was 50 seconds. Next, the coated particles were introduced to a fluidized bed dryer and dried at 250° C for 20 seconds to obtain a product granular detergent. The properties of the thus obtained detergent were shown in Table-2.

EXAMPLE 13

| | |
|---|---|
| Linear alkyl benzene sulfonate | 10 parts by weight |
| α-olefin sulfonate | 10 parts by weight |
| Sodium silicate | 18 parts by weight |
| Sodium carbonate | 7 parts by weight |
| Fluorescent agent | 1 part by weight |
| CMC | 1 part by weight |
| Sodium sulfate | 32 parts by weight |
| Water | 21 parts by weight |

The slurry consisting of the aforesaid ingredients was well mixed by means of a crusher and heated to 80° C, and then cooled to a temperature ranging from 30° to 33° C. The same was granulated by using a piston granulator so as to have a mean particle diameter of 1.2 mm. The detergent pellets were dried at 70° C for 20 minutes by means of a fluidized bed dryer to reduce the water content to 10%. 100 parts by weight of the thus obtained material granular detergent was introduced into a fluidization tower to be given a sufficient fluidity. Then, 4 parts by weight, calculated as the solids, of a 27% aluminum sulfate aqueous solution and 1.5 parts by weight, calculated as the solids, of a 15% sodium carbonate aqueous solution were each simultaneously spray-added, and 7 parts by weight of sodium sulfate having a mean particle diameter of 75 $\mu$ was also added thereto. Next, the coated particles were introduced into a fluidized bed dryer and dried at 250° C for 25 seconds to obtain a product granular detergent. The properties thereof were shown in Table-2.

COMPARATIVE EXAMPLE 6

The properties of the material granular detergent per se according to Example 6 were as shown in Table-2.

COMPARATIVE EXAMPLE 7

A product granular detergent was obtained by adding and drying, in accordance with the same procedure and conditions as in Example 6, 1 part by weight of a 20% sodium silicate aqueous solution as solid content in the place of the sesqui sodium carbonate of Example 6. The properties thereof were shown in Table-2.

COMPARATIVE EXAMPLE 8

100 parts by weight of the material granular detergent of Example 6 was introduced into a fluidization tower. Then, 15 parts by weight of water was sprayed through a nozzle, and at the same time sodium carbonate having a mean particle diameter of 80 $\mu$ was added thereto, thereby coating the surface of detergent particles. The coating time was 2 minutes. After completion of coating the same was introduced into a fluidized bed dryer, and was dried at 200° C for 10 seconds to thereby obtain a product granular detergent. The properties thereof were shown in Table-2.

COMPARATIVE EXAMPLE 9

100 parts by weight of the material granular detergent of Example 6, from which particles of 20 mesh or more were excluded, was introduced into a fluidization tower. Then, 10 parts by weight of water was spray-added thereto. After the passage of 1 minute from starting of coating operation 5 parts by weight of sodium sulfate having a mean particle diameter of 100 $\mu$ was added thereto. The total granulating time was 2 minutes and 30 seconds. The same was dried at 200° C for 10 seconds in a fluidized bed dryer after completion of said coating operation. The properties of thus granular detergent were shown in Table-2.

COMPARATIVE EXAMPLE 10

The properties of the material granular detergent per se obtained through the procedure of Example 13 were as shown in Table-2.

Table-2

| | Our sample | | | | | | | |
|---|---|---|---|---|---|---|---|---|
| | 6 | 7 | 8 | 9 | 10 | 11 | 12 | 13 |
| Solidification preventability* (%) | 0 | 0 | 2 | 0 | 0 | 3 | 0 | 0 |
| Fluidity** (angle of repose) | 43° | 42° | 43° | 43° | 43° | 44° | 43° | 43° |
| Pressure solidification property*** (%) | 0 | 0 | 0 | 0 | 0 | 6 | 0 | 0 |

| | Comparative example | | | | |
|---|---|---|---|---|---|
| | 6 | 7 | 8 | 9 | 10 |
| Solidification preventability* (%) | 100 | 4 | 60 | 80 | 70 |
| Fluidity** (angle of repose) | 49° | 43° | 44° | 45° | 44° |
| Pressure solidification property*** (%) | 6 | 5 | 4 | 4 | 7 |

Remarks:

*The solidification preventability was evaluated through the procedure comprising leaving the sample standing under the atmosphere of 35° C and 100 % in relative humidity for 48 hours, then sifting this sample by the use of a 4-mesh sieve, and measuring the amount of sample left on the sieve in terms of wt. %.

**The fluidity was measured by an angle at which the sample, being packing in a box of 9.2 × 5.6 × 2.5 cm and having its upper surface leveled, was gently slanted and began to flow (The less this angle, the better the fluidity).

***The pressure solidification property was evaluated through the procedure comprising packing the sample in a box of 8 × 10.2 cm, leveling the upper surface thereof, placing a glass plate of 7 × 9 cm, putting a weight of 2 kg thereon, leaving the same standing for 24 hours, then sifting this sample by the use of a 4-mesh sieve, and measuring the amount of sample on the sieve in terms of wt. %.

What is claimed is:

1. In a process for improving a granular detergent composition consisting essentially of 5 to 40 percent by weight of water-soluble surfactant selected from anionic and nonionic surfactants, and 40 to 95 percent by weight of water-soluble detergent builders, which comprises agitating said granular detergent composition and simultaneously spraying onto the surfaces of the particles of said detergent composition a substance to improve the non-caking property, the flowability property and the particle hardness of said detergent composition, the improvement which comprises: in said spraying step, spraying onto said granular detergent composition undergoing agitation a. a first coating agent selected from the group consisting of 1. an aqueous solution of a first material selected from the group consisting of alkali metal silicates, carbonates and hydroxides, and
2. said aqueous solution (1) together with a fine powder of a second material selected from the group consisting of alkali metal silicates, sulfates, carbonates and hydroxides, wherein the total amount of said first coating agent, calculated as the solids, is from 0.5 to 8 parts by weight, per 100 parts by weight of said detergent composition, and wherein in first coating agent (2) the weight ratio of said aqueous solution, calculated as the solids, to said fine powder is from 1/10 to 10/1, and b. a second coating agent consisting of an aqueous solution of aluminum sulfate, wherein the amount of said second coating agent, calculated as the solids, is from 1 to 10 parts by weight, per 100 parts by weight of said detergent composition so that said aluminum sulfate reacts with said first material on the surfaces of the detergent particles to form thereon a coating film of a water-insoluble or poorly water-soluble substance, the coating of the detergent particles being performed at a temperature of from 10° to 250° C for a time period of from 10 seconds to 10 minutes;

and drying the thus-coated detergent composition.

2. A process according to claim 1 in which said first coating agent consists of said first coating agent (2).

3. A process according to claim 1 in which said first coating agent consists of said first coating agent (1).

4. A process according to claim 3 in which said first material consists of sodium silicate.

5. A process according to claim 2 in which said first material consists of sodium silicate and said second material is selected from the group consisting of sodium sulfate and sodium carbonate.

6. A process according to claim 1 in which said first material is selected from the group consisting of sodium silicate, sodium sesquicarbonate, sodium hydroxide, sodium bicarbonate and sodium carbonate, and said second material is selected from the group consisting of sodium sulfate, sodium sesquicarbonate, sodium carbonate and sodium bicarbonate.

7. A process according to claim 2 wherein the second material is suspended in a gas and is sprayed onto said detergent composition separately from said aqueous solution (1).

8. In a process for improving a granular detergent composition consisting essentially of 5 to 40 percent by weight of water-soluble surfactant selected from anionic and nonionic surfactants, and 40 to 95 percent by weight of water-soluble detergent builders, which comprises agitating said granular detergent composition and simultaneously spraying onto the surfaces of the particles of said detergent composition a substance to improve the non-caking property, the flowability property and the particle hardness of said detergent composition, the improvement which comprises: in said spraying step, spraying onto said granular detergent composition undergoing agitation a. a first coating agent selected from the group consisting of 1. an aqueous solution of a first material selected from the group consisting of alkali metal silicates, carbonates and hydroxides, and
2. said aqueous solution (1) together with a fine powder of a second material selected from the group consisting of alkali metal silicates, sulfates, carbonates and hydroxides, wherein the total amount of said first coating agent, calculated as the solids, is from 0.5 to 8 parts by weight, per 100 parts by weight of said detergent composition, and wherein in first coating agent (2) the weight ratio of said aqueous solution, calculated as the solids, to said fine powder is from 1/10 to 10/1, and b. a second coating agent consisting of an aqueous solution magnesium sulfate, wherein the amount of said second coating agent, calculated as the solids, is from 1 to 10 parts by weight, per 100 parts by weight of said detergent composition so that said magnesium sulfate reacts with said first material on the surfaces of the detergent particles to form thereon a coating film of a water-insoluble or poorly water-soluble substance, the coating of the detergent particles being performed at a temperature of from 10° to 250° C for a time period of from 10 seconds to 10 minutes;

and drying the thus-coated detergent composition.

9. A process according to claim 8 in which said first coating agent consists of said first coating agent (2).

10. A process according to claim 8 in which said first coating agent consists of said first coating agent (1).

11. A process according to claim 9 in which said first material consists of sodium carbonate, and said second material is sodium carbonate.

12. A process according to claim 9 wherein the second material is suspended in a gas and is sprayed onto said detergent composition separately from said aqueous solution (1).

* * * * *